United States Patent [19]

Curtis

[11] 4,119,348

[45] Oct. 10, 1978

[54] LOOPED CABLE CONTROL DEVICE

[75] Inventor: Brian Matthew Curtis, Chesterfield, England

[73] Assignee: Perard Engineering Limited, Ripley, England

[21] Appl. No.: 769,178

[22] Filed: Feb. 16, 1977

[30] Foreign Application Priority Data

Feb. 20, 1976 [GB] United Kingdom ..... 06707/76

[51] Int. Cl.[2] ..... E21C 35/20

[52] U.S. Cl. ..... 299/43; 191/12 R; 137/355.28

[58] Field of Search ..... 299/43, 18, 19, 32, 299/34; 191/12 R; 137/355.16, 355.28

[56] References Cited

U.S. PATENT DOCUMENTS

| | | | |
|---|---|---|---|
| 3,578,810 | 5/1971 | Newstead | 299/43 |
| 3,997,039 | 12/1976 | Hubbard et al. | 299/43 X |

FOREIGN PATENT DOCUMENTS

| | | | |
|---|---|---|---|
| 1,050,436 | 12/1966 | United Kingdom | 299/43 |
| 1,127,362 | 9/1968 | United Kingdom | 299/43 |
| 1,335,384 | 10/1973 | United Kingdom | 299/43 |
| 1,410,906 | 10/1975 | United Kingdom | 299/43 |

*Primary Examiner*—Ernest R. Purser
*Assistant Examiner*—Nick A. Nichols, Jr.
*Attorney, Agent, or Firm*—Jones, Thomas & Askew

[57] ABSTRACT

A looped cable control device for use in guiding a supply cable to a mineral winning machine in a longwall mining installation to reduce the risk of damage, the device being mountable on a spill plate to form an elongate of side wall parallel to the spill plate, a platform being mounted between the spill plate and the goaf side wall, so that a trough is defined for receiving the supply cable, the goaf side wall being pivotally mounted for deflection towards the spill plate under impact, the goaf side wall having a projecting lever arm, which engages between a stop and a resilient member, so that the resilient member resists deflection and returns the wall to its normal position, risk of damage by the impact being, therefore, reduced.

4 Claims, 3 Drawing Figures

LOOPED CABLE CONTROL DEVICE

This invention relates to a looped cable control device for controlling a looped cable used to supply power or water to a mineral winning machine.

In longwall mining installations it is usual to provide a conveyor along a mineral face for removing cut mineral and a winning machine rides on top of the conveyor. The machine trails an electrical power cable and a water supply cable for spraying to reduce dust. A trough is provided alongside the conveyor to contain the cables to reduce the risk of the cables snagging and being damaged. U.K. patent specification No. 1,220,872 describes a trough which is defined at one side by an anti-spillage wall, at the bottom by a platform projecting from the wall and, at the opposite side, by a series of spaced brackets fixed to the platform. In this specification each bracket mounts a gate biased to a position closing the open top of the trough and operable by passage of the cables. Brackets of this type have also been provided having resiliently flexible legs to reduce the risk of damage to the brackets when struck, for example, by advancing roof supports.

The present invention provides a looped cable control device for controlling a looped cable used to supply power or water to a mineral winning machine, which traverses along a mineral face, the device comprising a body, mounting means for mounting the body on a spill plate, pivot means pivotally mounting the body on the mounting means, whereby, in use, a trough is defined between the body and the spill plate, for receiving the looped cable, and the body is pivotally movable in a direction transverse to the spill plate, stop means for limiting said pivotal movement away from the spill plate, and resilient means biasing the body into co-operation with the stop means and resiliently resisting said pivotal movement towards the spill plate.

The invention also provides a looped cable control device and spill plate assembly comprising a spill plate, a platform projecting transversely from the goaf side of the spill plate, a plurality of mounting members mounted on the spill plate beneath the platform, a goaf side wall assembly comprising an elongate wall and a plurality of legs spaced longitudinally of the wall, pivot means pivotally mounting each leg on a corresponding one of the mounting members about a horizontal axis parallel to the spill plate, each leg having an upright portion joined to the wall and a lever portion projecting substantially perpendicularly from the upright portion and towards the spill plate, stop means on the platform and resilient means carried by the mounting members, each lever portion being constrained between the stop means and the resilient means, whereby the wall is held in an upright position forming a trough with the platform and the spill plate for receiving a looped cable, the wall being deflectable towards the spill plate against the bias of the resilient means.

Using the invention, a strong goaf side wall can be constructed providing for substantially continuous protection of the cable along the mineral face. With the heavy machinery used in mines, this wall could be damaged, if it were rigid and by using the invention the wall can be made to deflect under heavy load towards the spill plates to reduce the risk of damage. The resistance to deflection is easily controlled by determining the resistance of the reilient means. It is desirable that deflection is strongly resisted up to the point where damage to the wall is likely, because of the problem of the supply cables being trapped in the trough. With resilient legs, we have found it difficult to control such deflection adequately.

Reference is now made to the accompanying drawings, wherein.

Figure 1:
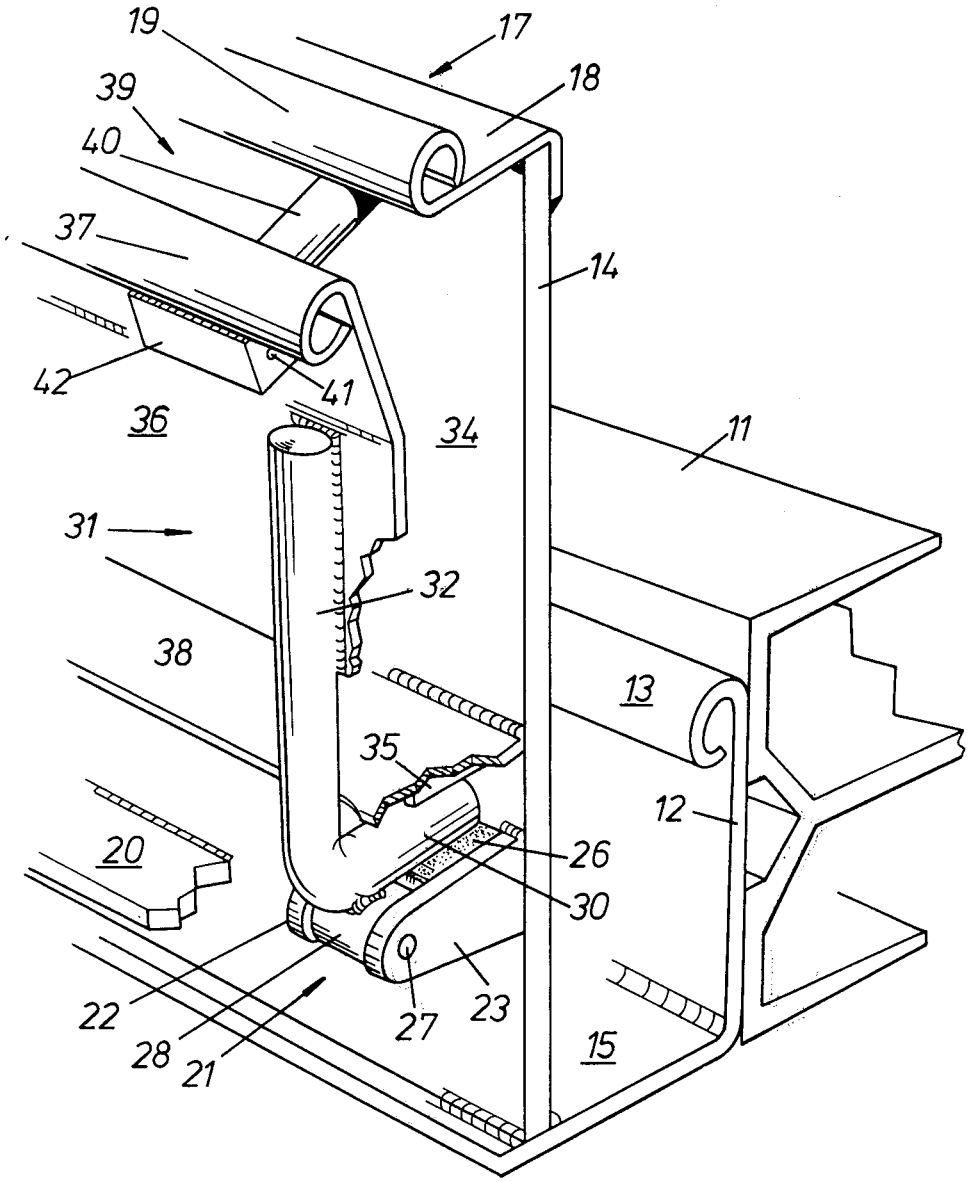
FIG. 1 is a perspective view of a part of an assembly of a looped cable control device and a spill plate, according to the invention.
Figure 2:
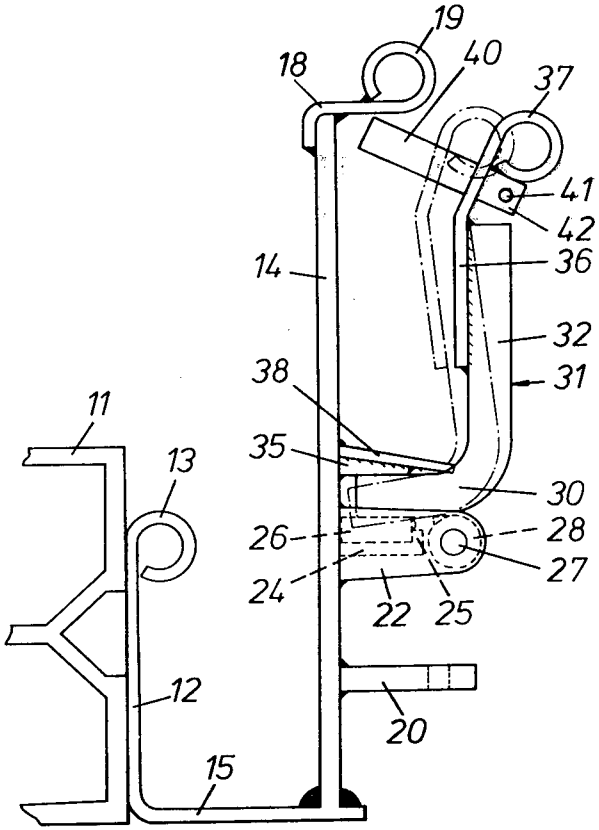
FIG. 2 is an end view of the assembly of FIG. 1.

Referring to FIGS. 1 and 2, there is shown a face conveyor 11 to which is attached an upright plate 12 having a rolled top 13. A spill plate 14 is spaced to the goaf side of the plate 12 and is connected thereto by a base plate 15. A channel is defined between the spill plate 14 and the plate 12 and, in use, a guide member (not shown) projecting from a winning machine, engages in the channel and beneath the rolled top 13. The machine is thereby guided as it moves along the top of the conveyor. The spill plate prevents spillage of the cut mineral to its goaf side. This arrangement is well known.

The spill plate has an upper marginal part 17, of L-section, welded thereto to define a flange 18 extending to the goaf side of the spill plate. The flange 18 has a rolled edge portion 19 for reinforcement. A clevis rail 20 projects to the goaf side of the spill plate for connection to self-advanceable roof supports (not shown) in conventional manner.

Above the clevis rail 20, a plurality of mounting members 21 (only one shown) are welded to the spill plate 14 and spaced therealong. Each mounting member comprises a pair of spaced lugs 22, 23, with a plate 24 welded therebetween (see FIG. 2). The plate 24 is provided with a lip 25 so that a rectangular recess is defined between the spill plate 14, the lugs 22, 23, the lip 25 and the plate 24. A resilient block 26 is contained and constrained in the recess and in this example is made of "Neoprene".

A pivot pin 27 extends between the lugs 22, 23 and a boss 28 is rotatably mounted on the pin. The boss is welded to a lever arm 30 of a leg 31. This lever arm 30 extends substantially horizontally towards the spill plate 14 and the leg 31 includes an upright portion 32, perpendicular to the lever arm. A similar leg is mounted on each of the mounting members spaced along the spill plate.

A bracket 35 is mounted above the lever arm 30 and similar brackets are provided above all of the lever arms. This bracket serves as a stop against which the lever arm abuts. The lever arm 30 is biased against the stop 35 by engaging with the resilient block.

An elongate plate defined a goaf side wall 36 and is welded to the upright portions 32 so as to be supported by the legs 31. The plate is slightly cranked and has a rolled top edge 37 for strength.

A platform 38 is mounted along the spill plate on top of the brackets 35.

A trough 34 is, therefore, formed between the platform 38, the spill plate 14 and the goaf side wall 36 together with the legs 31. The mouth 39 of the trough is offset towards the goaf side due to the partial closing of the top of the trough by the flange 18 and the cranking of the wall 36. This arrangement reduces the risk of cut mineral entering the trough.

The trough mouth 39 is closed at spaced intervals by a gate 40. This gate is a resilient member pivoted at 41 in a housing 42 for vertical deflection. The gate is spring-urged by a spring (not shown) to the closing position.

In use, as a winning machine traverses along the conveyor 11, its supply cables are trailed and are held captive in the trough 34. The trailing cables are looped and the loops move along the trough, the pressure of the loops on the gates opening them. The gates automatically close because of their spring bias. The gates, therefore, prevent the looped cables from being pulled out of the trough 34. Such gates are well known and a description of their operation and of the path of the looped cables is fully described in U.K. patent specification No. 1,220,872.

In the event of a heavy blow being suffered by the goaf side wall 36, the wall will pivot about the pins 27 against the resilient bias of the blocks 26 to reduce the risk of damage. A deflected position of the wall is shown in dash-dot lines in FIG. 2.

Figure 3:
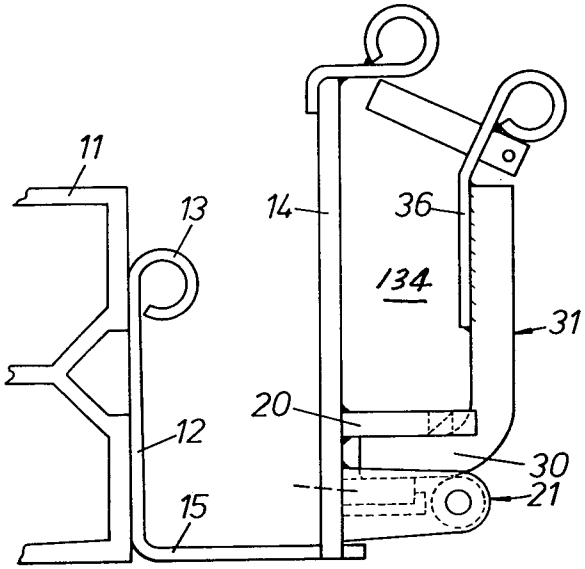
FIG. 3 is an end view similar to that of FIG. 2 of a modified construction.

Referring now to FIG. 3, the same numerals are used to identify the parts identical with those of FIGS. 1 and 2. In this modification, the platform 38 is omitted and the mounting members 21 are mounted below the clevis rail 20. The lever arm 30 again bears on the resilient block 26, but in this case, the clevis rail 20 itself serves as a stop against which the arm 30 bears. The trough 134 is defined between the spill plate 14, the clevis rail 20 and the goaf side wall 36 together with the legs 31.

What we claim is:

1. A looped cable control device for controlling a looped cable used to supply power or water to a mineral winning machine, which traverses along a mineral face, the device comprising an elongate wall, a plurality of longitudinally spaced legs secured to said wall for supporting the wall, each leg having an upright portion joined to the wall and an arm portion projecting substantially perpendicularly to the upright portion, mounting means for mounting said wall on a spill plate, pivot means pivotally mounting each of said legs on the mounting means, whereby, in use, a trough is defined between said wall and the spill plate, for receiving the looped cable, and said wall is pivotally movable in a direction transverse to the spill plate, stop means for limiting said pivotal movement away from the spill plate, and resilient means biasing the body into cooperation with the stop means and resiliently resisting said pivotal movement towards the spill plate, said arm portions of the legs being constrained between said stop means and said resilient means.

2. A looped cable control device according to claim 1, wherein the resilient means includes a resilient block.

3. A looped cable control device according to claim 2, wherein the mounting means includes a chamber housing and constraining the resilient block.

4. A looped cable control device and spill plate assembly comprising a spill plate, means projecting transversely from the goaf side of the spill plate, a plurality of mounting members mounted on the spill plate beneath said projecting means, a goaf side wall assembly comprising an elongate wall and a plurality of legs spaced longitudinally of the wall, pivot means pivotally mounting each leg on a corresponding one of the mounting members about a horizontal axis parallel to the spill plate, each leg having an upright portion joined to the wall and a lever portion projecting substantially perpendicularly from the upright portion and towards the spill plate, stop means on said projecting means and resilient means carried by the mounting members, each lever portion being constrained between the stop means and the resilient means, whereby the wall is held in an upright position forming a trough with said projecting means and the spill plate for receiving a looped cable, the wall being deflectable towards the spill plate against the bias of the resilient means.

* * * * *